US006329922B1

(12) United States Patent
Kosugi et al.

(10) Patent No.: US 6,329,922 B1
(45) Date of Patent: Dec. 11, 2001

(54) FIRE DETECTOR AND NOISE DE-INFLUENCE METHOD

(75) Inventors: Naoki Kosugi, Sagamihara; Masayuki Ito, Hachiouji, both of (JP)

(73) Assignee: Hochiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,480

(22) Filed: Jul. 24, 2000

(30) Foreign Application Priority Data

Jul. 27, 1999 (JP) ..... 11-211929

(51) Int. Cl.[7] ..... G08B 17/00

(52) U.S. Cl. ..... 340/587; 3470/577; 3470/628; 3470/630; 250/573; 250/574; 356/432; 356/434

(58) Field of Search ..... 340/587, 577, 340/579, 628, 629, 630, 619; 250/574, 573; 356/432, 433, 434, 438, 445, 446

(56) References Cited

U.S. PATENT DOCUMENTS 4,171,490 * 10/1979 Tatetsuki et al. ..... 250/564
4,481,506 * 11/1984 Honma ..... 340/630
4,626,695 * 12/1986 Keeler ..... 250/574
5,302,837 * 4/1994 Sawa et al. ..... 250/574
5,751,216 * 5/1998 Narumiya ..... 340/630
5,859,706 * 1/1999 Nagashima et al. ..... 356/394
5,945,924 * 8/1999 Marman et al. ..... 340/928

* cited by examiner

*Primary Examiner*—Daniel J. Wu
*Assistant Examiner*—Toan Pham
(74) *Attorney, Agent, or Firm*—Lackenbach Siegel Marzullo Aronson & Greenspan

(57) ABSTRACT

It is prevented that a malfunction occurs because of a noise. A smoke detection section samples as a smoke detection signal a signal digitized after being output from a light reception section when a light emission section glows, and updates a previous smoke detection signal. A noise detection section samples as a noise detection signal a signal output from the light reception section when the light emission section is not driven to glow. When the noise detection signal exceeds a predetermined noise level, a noise de-influence unit disables updating of the previous smoke detection signal with the newly sampled smoke detection signal so as to process a noise.

27 Claims, 12 Drawing Sheets

| FIG.4A | FIG.4B |
|---|---|

FIRE DETECTOR AND NOISE DE-INFLUENCE METHOD

BACKGROUND OF THE INVENTION

1. Field of the Invention

The present invention relates to a fire detector in which a light emission section is driven to glow at regular intervals, light emitted from the light emission section and varied depending on smoke stemming from a fire is received by a light reception section and sampled as a smoke detection signal, and a noise de-influence method for the fire detector.

2. Description of the Related Art

In photoelectric fire detectors for detecting smoke that stems from a fire, a light emission section is driven to glow at regular intervals. Light emitted from the light emission section and then scattered or attenuated due to smoke stemming from a fire is received by a light reception section, converted into an electric signal, and sampled as a smoke detection signal proportional to the concentration of the smoke.

The fire detectors fall into analog fire detectors and so-called on-off fire detectors. The analog fire detectors sample the smoke detection signal in response to a command sent from an upper-level device such as a receiver or a relay, and transmit the smoke detection signal to the upper-level device. The upper-level device finally judges whether a fire has broken out. The on-off fire detectors transmit a fire detection signal to the upper-level device when detecting that the smoke detection signal has exceeded a fire level.

The conventional photoelectric fire detectors must take measures against noises occurring on a power supply line or noises occurring in the air for fear they may malfunction. Recently, there is an increasing demand for fire detectors unsusceptible to high-frequency noises along with prevalence of portable telephones. Moreover, international standardization organizations including the International Electrotechnical Commission (IEC) tend to stipulate stricter standards concerning noises.

Conventional countermeasures against noises include addition of noise absorption elements to a circuit and devised patterning of a printed-circuit board. In the analog fire detector, a microprocessor (hereinafter MPU) is included for suppressing a variation of a sampled smoke detection signal caused by a noise according to the method of moving averages or the like.

However, the noise-related standards have come to cover high-frequency noises. Moreover, the intensities of the noises have increased. The addition of noise absorption elements or the devised patterning has therefore reached its limitations. Besides, when the MPU is used to reduce a variation of a sampled smoke detection signal according to the method of moving averages, a caused by an instantaneous noise can be reduced. However, when a noise persists for a long period of time, the MPU cannot reduce the noise, at the worst case, a malfunction occurs.

Another countermeasure against noises is such that the printed-circuit etc, board are encapsulated in a shield case in order to block radio waves (refer to U.S. Pat. No. 4,897, 634).

In this case, as shown in FIG. 11, the circuitry for a fire detector circuit base 100 is realized in the form of a double-sided printed-circuit board 115 whose lower surface is coated with a copper foil in order to block radio waves. A metallic shield case 120 is placed on the printed-circuit board 115, thus de-influencing the adverse effects of radio waves on circuit elements 116. Moreover, a light-emitting element 108, a light-receiving element 109, and a capacitor 117 mounted on the lower surface of the double-sided printed-circuit board 115 are covered with a light-emitting element holder, a light-receiving element holder 107, and a capacitor holder 114 and thus unsusceptible to radio waves.

However, particularly, the light-receiving element 109 should be protected by the noise. So the light-receiving element 109 was only protected by metal-sealed-cap (not shown), which is in the element holder 107.

In FIG. 11, there are shown a body cover 101, a contact pin 102, an outer cover 103, a smoke inlet 103*a*, and a smoke-sensing section 104. A wire net 102 prevents invasion of insects into the smoke-sensing section 104.

When a seal member shields for a fire detector heavily, the number of components increases and the number of assembling steps increases. This may lead to an increase in costs.

An object of the present invention is to provide a fire detector that is prevented from malfunctioning because of noises, and a noise de-influence method for the fire detector.

SUMMARY OF THE INVENTION

For accomplishing the above object, according to the present invention, there is provided a photoelectric fire detector having a light emission section, a light reception section, and a smoke detection section. The light emission section is driven to glow at regular intervals. The light reception section receives light emitted from the light emission section and varied depending on smoke. The smoke detection section samples as a smoke detection signal a signal output from the light reception section when the light emission section glows, and updates a previous smoke detection signal.

According to the present invention, the photoelectric fire detector includes a noise detection section and a noise de-influence unit. The noise detection section samples as a noise detection signal a signal output from the light reception section when the light emission section does not glow. When the noise detection signal exceeds a predetermined noise judgment level, the noise de-influence unit processes to eliminate influence of a noise or de-influences a noise.

When the noise detection signal exceeds the predetermined noise judgment level, the noise de-influence unit disables updating of a previous smoke detection signal with a smoke detection signal newly sampled by the smoke detection section, and thus processes to de-influences a noise.

In the fire detector in accordance with the present invention, an analog signal output when an LED included in a light emission section does not glow is sampled as a noise detection signal by the noise detection section. When the noise detection signal whose level is initially zero rises due to a noise and exceeds the predetermined noise judgment level, it is judged that smoke detection is affected by the noise. When it is judged that smoke detection is affected by a noise, a smoke detection signal output at that time is canceled for fear the fire detector may judge that a fire has broken out. Thus, the noise is de-influenced.

It can therefore be reliably prevented that the fire detector malfunctions because of a smoke detection signal to which a noise is continuously appended during an action period during which a received light amplification circuit is in action.

A lot of noise absorption elements that cost high need not be included. Noises can be coped with using a minimum necessary number of noise absorption elements. Moreover, it is unnecessary to heavily shield a fire detector. Besides, devised patterning to be achieved through cutting and trial is not needed. Once patterning is devised to some extent, noises can be coped with. It takes little time to retrofit a fire detector so that the fire detector will become unsusceptible to noises.

The light reception section includes the received light amplification circuit that acts for a certain period starting before and ending after a glowing period during which the light emission section glows. The noise detection section samples a noise detection signal for a time other than the glowing period within the action period of the received light amplification circuit. Thus, noise detection is carried out during the action period of the received light amplification circuit except the glowing period. This obviates the necessity of adding another received light amplification circuit.

According to the present invention, the noise detection section included in the fire detector samples a noise signal when a time, during which noise detection is unaffected by the light emission section, has elapsed after the glowing period of the light emission section. Consequently, noise detection can be achieved accurately while being unaffected by afterglow occurring after the light emission section glows.

According to the present invention, even when a noise detection signal does not exceed a predetermined noise judgment level, if the noise detection signal has exceeded the predetermined noise judgment level for a past certain time, the noise de-influence unit included in the fire detector disables updating of a previous smoke detection signal with a smoke detection signal newly sampled by the smoke detection section.

This is because a smoke detection signal may vary largely or may alternately become abnormal and normal. Noise de-influence is therefore performed continuously for a certain time. Even if no noise is detected any longer during noise de-influence, unless the absence of a noise persists for a certain time, a normal smoke detection signal sampled before a noise detection signal exceeds the noise judgment level is held intact. If the noise detection signal does not exceed the noise judgment level continuously for the certain time, an up-to-date smoke detection signal is adopted and held. The fire detector then goes into its ordinary action.

According to the present invention, the fire detector further includes a temperature detection section for detecting ambient temperature. When a temperature detected by the temperature detection section exceeds a predetermined value, the noise de-influence unit forcibly discontinues noise de-influence.

If a fire breaks out actually, detection of the fire may be retarded with noise de-influence. For this reason, the temperature detection section is added. If a detected temperature exceeds a certain value, noise de-influence is forcibly discontinued in order to bring the fire detector into its ordinary action. Even if a noise occurs, a smoke detection signal is sampled efficiently and used for updating. It is thus prevented that detection of a fire is retarded with noise de-influence.

According to the present invention, when a temperature detected by the temperature detection section included in the fire detector exceeds the predetermined value, if the detected temperature is higher than a previously-detected temperature, a certain value is added to the previously detected temperature and the resultant value is output as a newly detected temperature.

The temperature detection section may be affected by a noise, and a detected temperature may exhibit an abrupt rise. In this case, noise de-influence that is under way in the fire detector may be discontinued incorrectly. In general, it is rare that a detected temperature exhibits an abrupt rise relative to the previously detected one. It is therefore necessary to prevent the temperature detection section from outputting an incorrect signal because of a noise. In the fire detector, the present invention, when the output of the temperature detection section exhibits an abrupt rise because of a noise, a certain value is added to the previously detected temperature and the resultant temperature is output temporarily as a newly detected temperature but noise de-influence is not discontinued. If the temperature rise is derived from a noise, the next and subsequent detected temperatures will assume normal values falling below the predetermined value because the temperatures are detected while being unaffected by a noise. In contrast, if the output of the temperature detection section is a normal signal representing a temperature detected while being unaffected by a noise, the subsequent detected temperatures will exceed the predetermined value and exhibit a continuous rise. The certain value is continuously added to a previously detected temperature. The resultant temperature will exceed the predetermined value in due course. Consequently, noise de-influence performed as part of smoke detection is discontinued in order to bring the fire detector into its ordinary action.

According to the present invention, the fire detector may be designed to be of an analog type for sending a smoke detection signal to an upper-level device such as a receiver or repeater so that the upper-level device can judge whether a fire has broken out. In this case, a transmission section is included for transmitting a smoke detection signal sampled by the smoke detection section in response to a command sent from the upper-level device such as a receiver or repeater.

According to the present invention, the fire detector may be designed to be of an on-off type for judging by itself from a smoke detection signal whether a fire has broken out. In this case, a fire signal transmission section is included for transmitting a fire detection signal to an upper-level device such as a receiver or repeater when a smoke detection signal sampled by the smoke detection section exceeds a predetermined fire judgment level.

According to the present invention, there is provided a fire detector having a light emission section, a light reception section, a smoke detection section, and a fire judgment section. The light emission section glows at regular intervals. The light reception section receives light emitted from the light emission section and varied depending on smoke. The smoke detection section samples as a smoke detection signal a signal output from the light reception section when the light emission section glows. When the smoke detection signal sampled by the smoke detection section exceeds a predetermined fire judgment level, the fire judgment section judges that a fire has broken out. The fire detector further includes a noise detection section for sampling as a noise detection signal a signal output from the light reception section when the light emission section does not glow. When the noise detection signal sampled by the noise detection section exceeds a predetermined noise judgment level, the fire judgment section is disabled from performing fire judgment or providing a fire output.

Furthermore, according to the present invention, there is provided a noise de-influence method for the fire detector. When a noise detection signal exceeds a predetermined noise judgment level, a noise is de-influenced.

According to the present invention, the noise de-influence method for the fire detector is characterized in that a signal output from a light reception section for receiving light emitted from a light emission section and varied depending on smoke that stems from a fire is sampled as a smoke detection signal. Moreover, a previous smoke detection signal is updated with the detected smoke detection signal. A signal output from the light reception section when the light emission section does not glow is sampled as a noise detection signal. When the noise detection signal exceeds a predetermined noise judgment level, updating a previous smoke detection signal with the newly sampled smoke detection signal is disabled in order to de-influence a noise.

DESCRIPTION OF THE PREFERRED EMBODIMENTS

Figure 1:
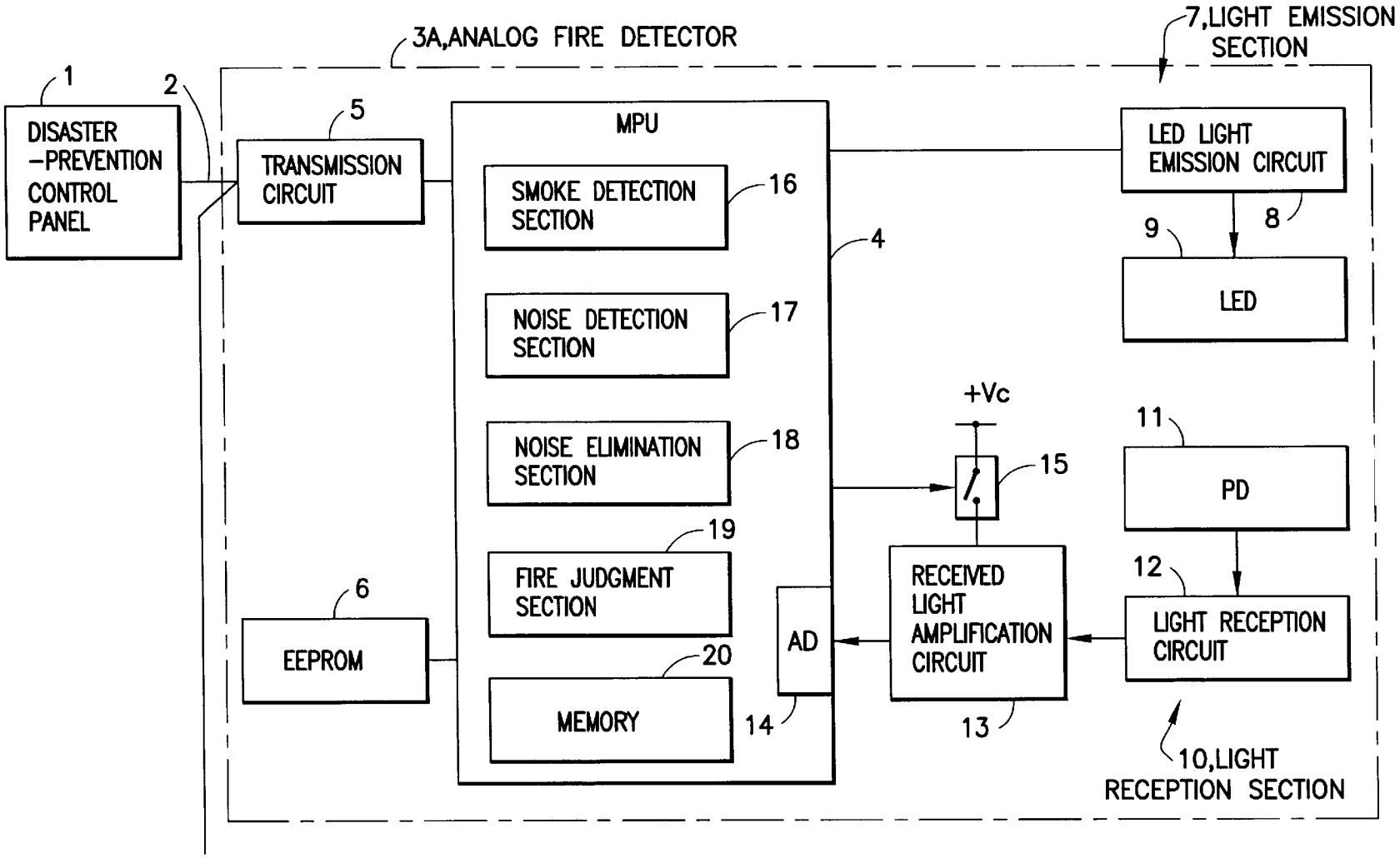
FIG. 1 is a block diagram of an analog fire detector with a noise de-influence facility in accordance with the present invention.

FIG. 1 is a block diagram showing an analog fire detector with a noise de-influence facility in accordance with the present invention.

In FIG. 1, an analog fire detector 3A with a noise de-influence facility in accordance with the present invention is connected to a 1 over a transmission line 2. In practice, one analog fire detector or a plurality of analog fire detectors is connected to the disaster-prevention panel receiver 1 over the transmission line 2. For brevity's sake, only one analog fire detector 3A appears to be connected to the disaster-prevention panel receiver 1.

The analog fire detector 3A has an MPU 4 serving as a control section, a transmission circuit 5, a EEPROM 6 that is a nonvolatile memory, a light emission section 7, and a light reception section 10. The light emission section 7 includes an LED light emission circuit 8 and an infrared LED 9 serving as a light-emitting element. The light reception section 10 includes a photodiode (PD) 11 serving as a light-receiving element, a light reception circuit 12, a received light amplification circuit 13, and a switch 15. The switch 15 is turned on under the control of the MPU 4 in order to supply power to the received light amplification circuit 13.

The MPU 4 includes an A/D converter 14. In this example, a light reception signal output from the received light amplification circuit 13 is sampled according to predetermined timing. Moreover, the MPU 4 has facilities serving as a smoke detection section 16, a noise detection section 17, a noise de-influence unit 18, and a fire judgment section 19.

Stored in the EEPROM 6 are inherent address data, fire judgment level data, noise judgment level data, and so on.

The disaster-prevention panel receiver 1 acquires smoke detection signals sampled by a plurality of analog fire detectors 3A connected over the transmission line 2 in the course of polling, and finally judges whether a fire has broken out. For example, 127 analog fire detectors 3A can be connected to the disaster-prevention panel receiver 1. The analog fire detectors 3A are assigned addresses 1 to 127 for facilitating polling.

The disaster-prevention panel receiver 1 transmits a sampling command (A/D conversion command) to all the analog fire detectors 3A at regular intervals of, for example, 3 sec. The sampling command is used to instruct the analog fire detectors 3A to sample a smoke detection signal. Thereafter, the disaster-prevention panel receiver 1 transmits a polling command to up to 127 analog fire detectors 3A. The addresses of the analog fire detectors are specified orderly in the polling command.

In the analog fire detector 3A having received the sampling command sent at intervals of 3 sec from the disaster-prevention panel receiver 1, the MPU 4 then performs fire detection to sample a smoke detection signal in response to the sampling command. For the fire detection, the light emission section 7 is driven to glow, and the light reception section 10 receives light.

Specifically, in response to the sampling command sent from the disaster-prevention panel receiver 1 via the transmission circuit 5, the MPU 4 first turns on the switch 15 included in the light reception section 10 so as to activate the received light amplification circuit 13. In this state, the MPU 4 outputs a control pulse to the LED light emission circuit 8 so that the infrared LED 9 will glow.

In a generally adopted scattered-light type smoke sensor, the infrared LED 9 and photodiode 11 are arranged at a predetermined angle in the smoke detection section. When smoke flows into the smoke detection section included in the sensor body, light from the infrared LED 9 is scattered by the smoke, received by the photodiode 11, and converted into an electric signal. The signal is sent to the light reception circuit 12 and amplified by the received light amplification circuit 13. Thereafter, the resultant signal is fed to the A/D converter 14. The MPU 4 activates the A/D converter 14 synchronously with the glowing timing according to which the infrared LED glows, samples a smoke detection signal, and stores the signal in a memory 20 incorporated in the MPU 4.

Sampling a smoke detection signal in response to a sampling command sent from the disaster-prevention panel receiver 1 is performed by the smoke detection section serving as a facility of the MPU 4. Specifically, the smoke detection section 16 drives the light emission section 7 in response to a sampling command so as to cause the light emission section 7 to glow. A signal fed from the light reception section 10 at this time is digitized using the A/D converter 14. The smoke detection signal is sampled and it stored in the memory 20 incorporated in the MPU 4.

A smoke detection signal previously sampled in response to a sampling command is already held in the memory 20. The newly sampled smoke detection signal is overwritten in order to update the previous smoke detection signal. Thus, an up-to-date smoke detection signal is recorded or held in the memory 20 all the time.

Figure 2:
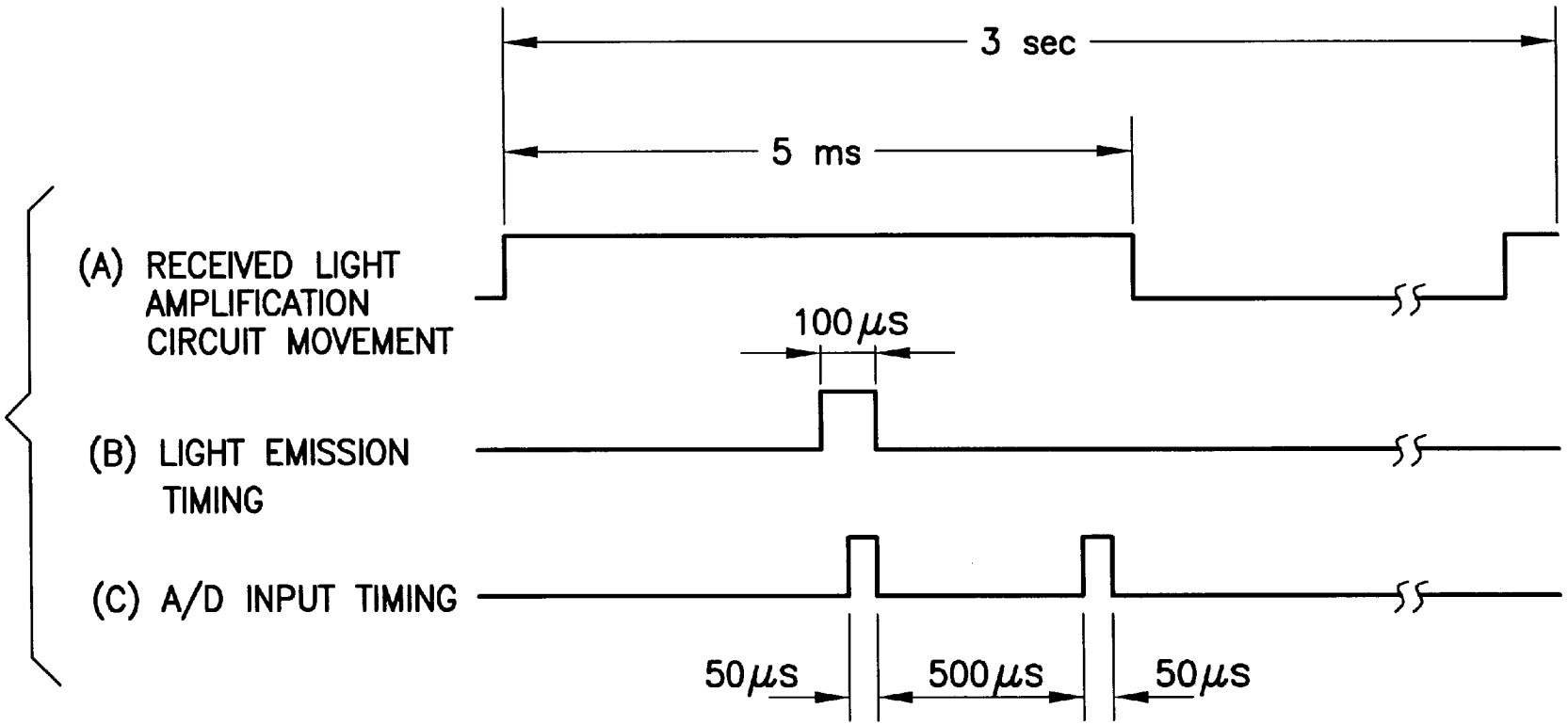
FIG. 2 is a timing chart indicating the timings according to which a received light amplification circuit, an infrared LED, and an A/D converter shown in FIG. 1 go into action.

FIG. 2 is a timing chart indicating the timings according to which the received light amplification circuit 13 included in the light reception section 10 goes into action, the infrared LED 9 glows, and the A/D converter 14 converts an analog signal into a digital signal. The received light amplification circuit 13, infrared LED 9, and A/D converter 14 are involved in the action of the smoke detection section 16 shown in FIG. 1 of digitizing and sampling a smoke detection signal.

In response to a sampling command sent from the disaster-prevention panel receiver 1, as shown in FIG. 2A, the MPU 4 turns on the switch 15 so as to supply power for 5 ms. This brings the received light amplification circuit 13 included in the light reception section 10 into action. When the action of the received light amplification circuit 13 is stabilized fully, the infrared LED 9 is, as shown in FIG. 2B, driven to glow for approximately 100 $\mu$s.

During the last 50 $\mu$s within the glowing period, a reception signal fed from the received light amplification circuit 13 is, as shown in FIG. 2C, digitized by the A/D converter 14, and a smoke detection signal is sampled.

The noise detection section 17 serving as a facility of the MPU 4 shown in FIG. 1 causes the A/D converter 14 to digitize an output signal of the received light amplification circuit 13 during the action period of the received light amplification circuit 13 except the glowing period of the infrared LED 9. The noise detection section 17 then samples a noise detection signal. In other words, as shown in FIG. 2C, the noise detection section 17 causes the A/D converter 14 to digitize the noise detection signal during 50 As according to the timing that a sufficiently long time has elapsed since the end of the glowing period, 100 $\mu$s, of the infrared LED 9 shown in FIG. 2B within the action period, 5 ms, of the received light amplification circuit 13 shown in FIG. 2A. In other words, the noise detection section 17 causes the A/D converter 14 to digitize the noise detection signal according to the timing that 500 $\mu$s has elapsed since the end of the glowing period.

When the smoke detection section 16 has sampled a smoke detection signal and the noise detection section 17 has sampled a noise detection signal, the noise de-influence unit 18 serving as a facility of the MPU 4 shown in FIG. 1 judges whether the noise detection signal exceeds a predefined noise judgment level. If the noise detection signal exceeds the noise judgment level, the noise de-influence unit 18 does not update a previous smoke detection signal with the smoke detection signal sampled by the smoke detection section 16. Consequently, when a large noise exceeding the noise judgment level is detected, the noise de-influence unit 18 de-influences the noise.

When the noise detection signal is lower than the noise judgment level, the noise de-influence unit 18 updates a previous smoke detection signal stored in the memory 20 by overwriting the up-to-date smoke detection signal sampled by the smoke detection section 16.

Figure 3:
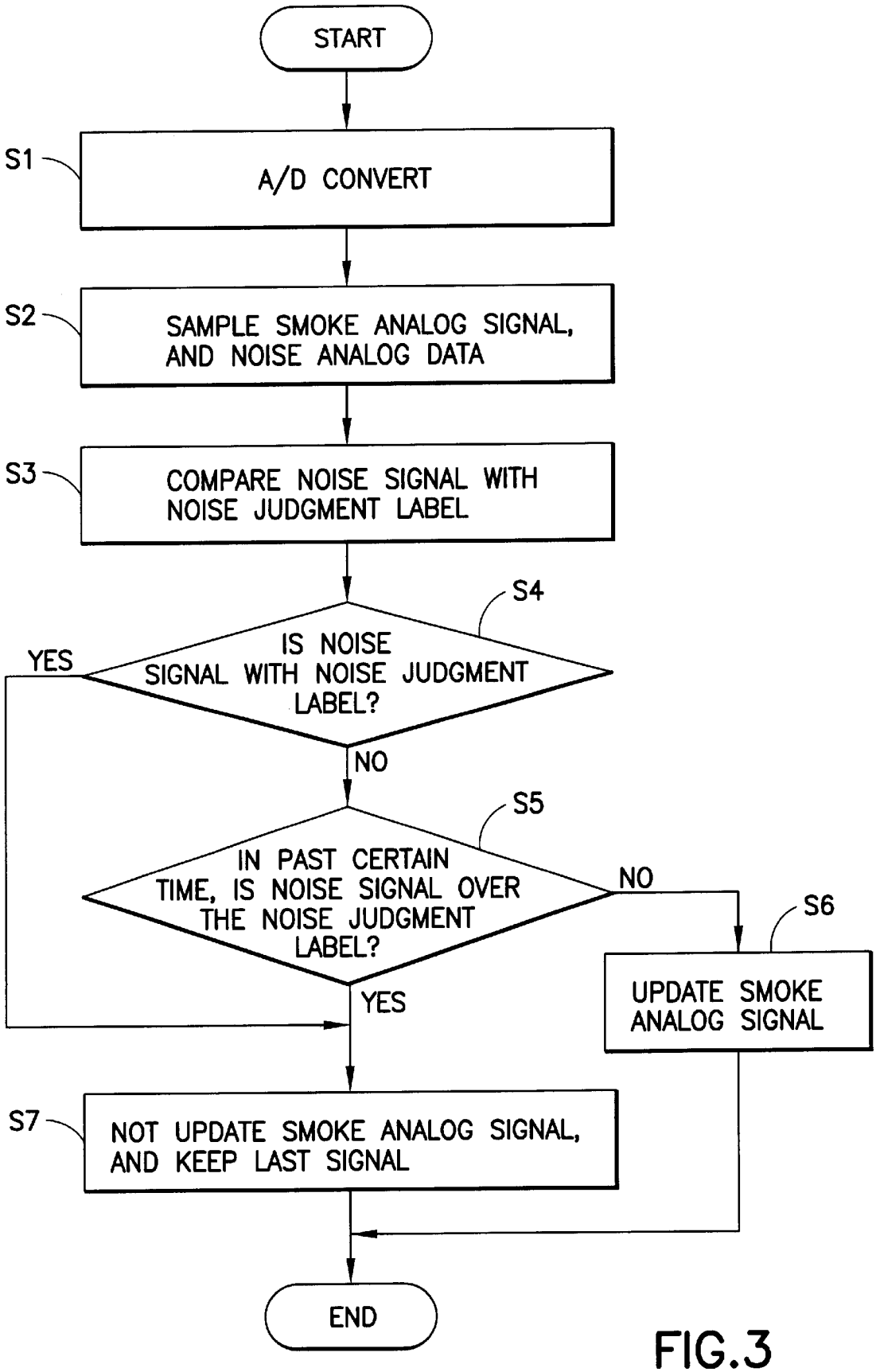
FIG. 3 is a flowchart describing smoke detection and noise de-influence to be performed by an MPU shown in FIG. 2.

FIG. 3 is a flowchart describing smoke detection and noise de-influence to be performed by the analog fire detector 3A shown in FIG. 1. The processing described in FIG. 3 is performed in response to a sampling command sent from the disaster-prevention panel receiver 1. At step S1, a detection signal is digitized. Specifically, as shown in FIG. 2C, the initial analog-to-digital conversion is performed during the glowing period of the infrared LED 9 within the action period of the received light amplification circuit 13 that is brought into action synchronously with the sampling command sent from the disaster-prevention panel receiver 1. The next analog-to-digital conversion is performed according to the timing that 500 $\mu$s has elapsed since the end of the initial analog-to-digital conversion. The timing comes while the infrared LED 9 is not glowing but the received light amplification circuit 13 is in action.

Thus, at step S2, a smoke detection signal is sampled through analog-to-digital conversion during the glowing period, and a noise detection signal is sampled through analog-to-digital conversion after the glowing period.

A smoke detection signal digitized by the A/D converter 14 represents 255 at most in the decimal notation. A smoke detection signal sampled when no smoke is present represents, for example, 60. When smoke flows into the smoke detection section of the sensor, the smoke detection signal rises. When the smoke detection signal exceeds a fire judgment level set to represent, for example, 150, the fire judgment section 19 judges that a fire has broken out. In the example shown in FIG. 1, it is the disaster-prevention panel receiver 1 that makes a final judgment from the smoke detection signal on whether a fire has broken out.

When the smoke detection signal and noise detection signal have been sampled at step S2, the noise de-influence unit 18 shown in FIG. 1 performs noise de-influence at steps S3 to S7. In the noise de-influence, the noise detection signal digitized by analog-to-digital conversion is compared with the predefined noise judgment level.

If it is found at step S4 through the comparison that the noise detection signal does not exceed the noise judgment level, it is judged that the smoke detection signal is not affected by a noise. Control is then passed to step S5. It is then checked if a noise detection signal having been sampled for a past certain time exceeds the noise judgment level.

The certain time defined to check if any noise detection signal sampled for the certain time exceeds the noise judgment level corresponds to 15 sampling intervals. For example, when a sampling command is issued at intervals of 3 sec, the certain time is calculated according to 15×3 sec=45 sec. The noise detection signal is checked to see if it has exceeded the noise judgment level for the past 45 sec, that is, during 15 analog-to-digital conversions.

If the noise detection signal has not exceeded the noise judgment level for the past certain time, it is judged that no noise affects the smoke detection signal. At step S6, a previous smoke detection signal is updated with a newly sampled smoke detection signal. Consequently, the up-to-date smoke detection signal is stored in the memory 20.

A polling command successively specifying the addresses 1 to 127 of the analog fire detectors 3A is received subsequently to the sampling comment sent from the disaster-prevention panel receiver 1 at intervals of 3 sec. When an address specified in the polling command corresponds to an own address, the up-to-date smoke detection signal is read from the memory 20 and then transmitted as reply data to the polling command to the disaster-prevention panel receiver 1.

If it is found at step S4 in FIG. 3 that the noise detection signal has exceeded the noise judgment level, control is passed to step S7. The previous smoke detection signal held in the memory 20 is not updated but held intact.

More particularly, a noise detection signal sampled after being digitized through analog-to-digital conversion when the infrared LED 9 does not glow, that is, no noise occurs represents 0. The noise judgment level with which a noise detection signal is compared at step S4 is set to represent, for example, 20. When the noise detection signal exceeds the noise judgment level of 20, control is passed to step S7. Updating the previous smoke detection signal with the up-to-date smoke detection signal containing a noise is disabled, and the previous smoke detection signal is held intact.

Owing to the noise de-influence, even if a smoke detection signal exceeding a fire judgment level is sampled because of a noise, it will not be judged incorrectly that a fire has broken out. Specifically, assume that the previous smoke detection signal held in the memory 20 represents 60, and a smoke detection signal sampled at this time represents 160, and a noise detection signal sampled at this time represents 100. Since the noise detection signal represents 100 and exceeds the noise judgment level representing 20, the smoke detection signal representing 160 and being held in the memory is not updated but held intact.

The smoke detection signal representing 60 is held intact and does not exceed the fire judgment level representing 150. It will therefore not be judged that a fire has broken out. But for the noise de-influence in accordance with the present invention, the smoke detection signal in the memory 20 would be updated to represent 160 exceeding 150 represented by the fire judgment level. It would be judged incorrectly that a fire has broken out.

If it is found at step S5 in FIG. 3 that the noise detection signal has exceeded the noise judgment level for the past certain time, it is judged that a noise affecting the smoke detection signal may have occurred. Control is therefore passed to step S7. The previous smoke detection signal held in the memory 20 will not be updated and held intact.

When an address specified in a polling command succeeding a sampling command sent from the disaster-prevention panel receiver 1 agrees with an own address, the previous smoke detection signal is transmitted as reply data to polling to the disaster-prevention panel receiver 1.

Figures 4, 4A:
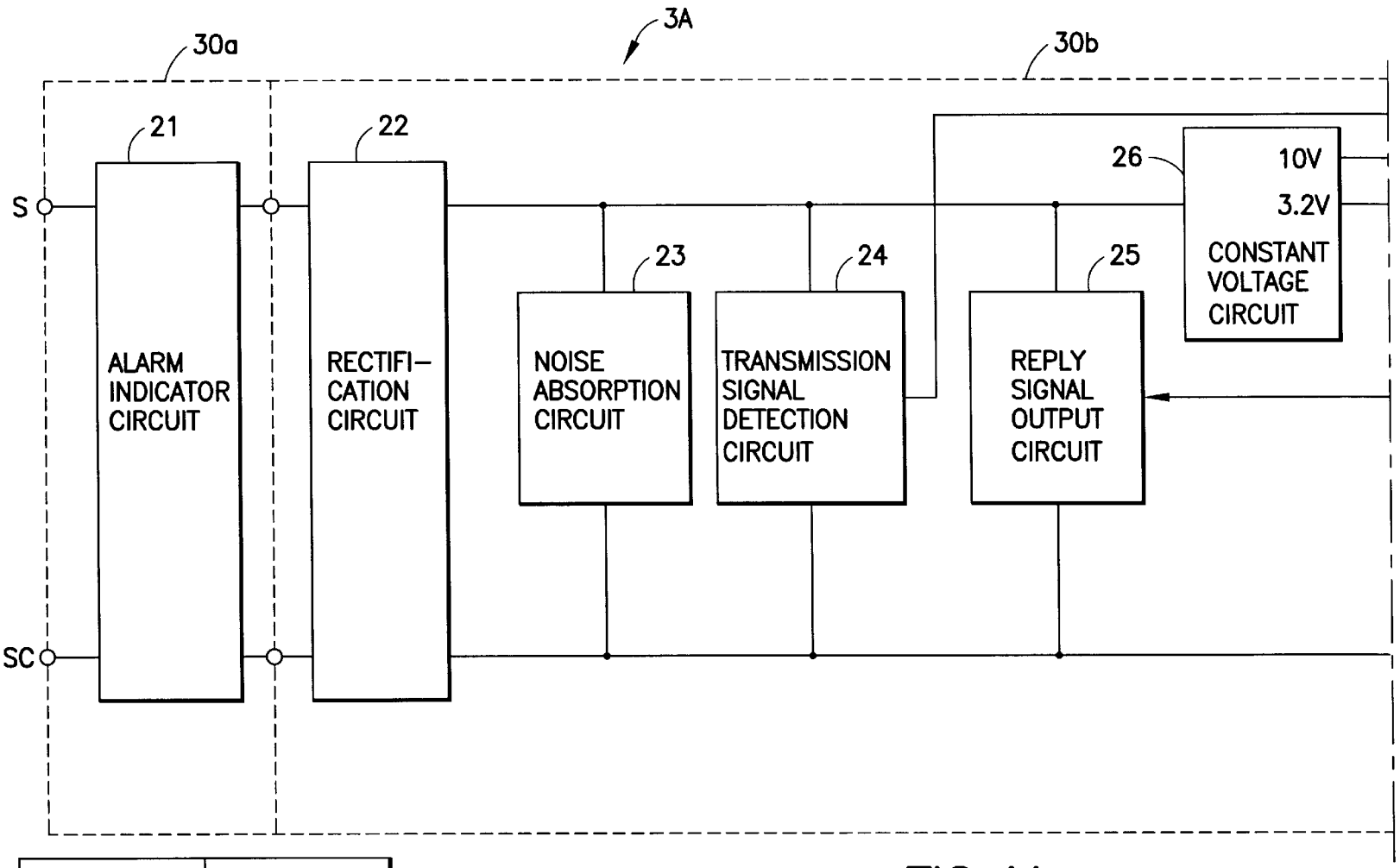
FIG. 4 is a circuit diagram showing a practical example of the analog fire detector shown in FIG. 1.
Figure 4B:
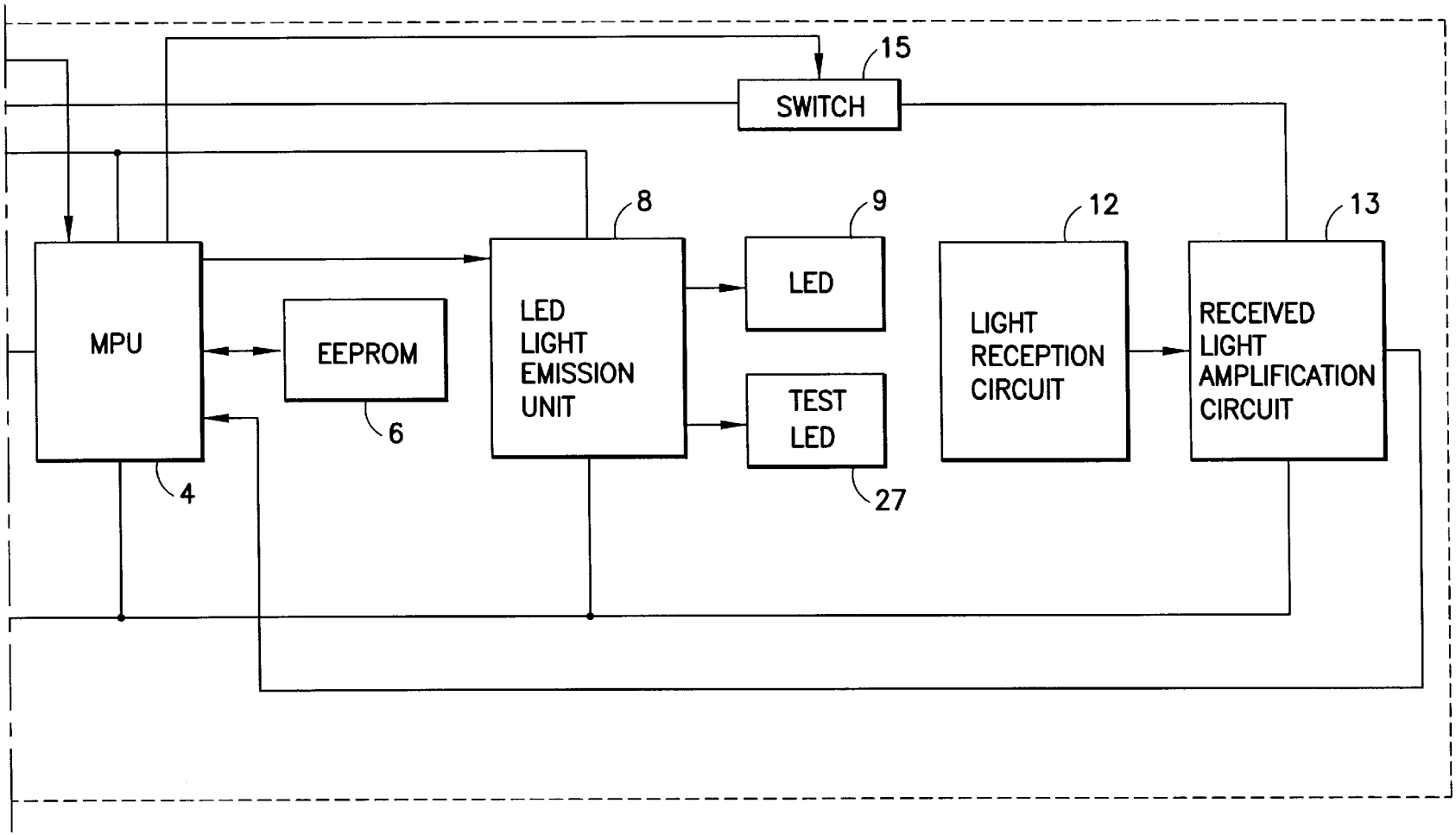

FIG. 4 is a block diagram showing a practical example of the analog fire detector 3A shown in FIG. 1. Referring to FIG. 4, the analog fire detector 3A consists of a sensor base 30*a* and a sensor body 30*b*. The sensor body 30B includes a rectification circuit 22, a noise absorption circuit 23, a transmission signal detection circuit 24, and a reply signal output circuit 25. The rectification circuit 22 nullifies the polarity of a signal sent from the sensor base.

The transmission signal detection circuit 24 and reply signal output circuit 25 constitute the transmission circuit 5 shown in FIG. 1. The transmission signal detection circuit 24 detects a calling signal that carries a sampling command or polling command in the form of a voltage and is sent from the disaster-prevention panel receiver 1, and feeds the signal to the MPU 4.

Information including an address, a fire judgment level, and a noise judgment level is held in the EEPROM 6 that is a nonvolatile memory connected to the MPU 4. In response to a sampling command, the MPU 4 starts sampling of a smoke detection signal that is accompanied by noise de-influence described in FIG. 3. In response to a polling command, the MPU 4 reads digital data of the smoke detection signal from the memory 20, and returns it as reply data to polling to the disaster-prevention panel receiver 1.

Smoke detection involves the LED light emission circuit 8, infrared LED 9, light reception circuit 12, received light amplification circuit 13, and switch 15. The light reception circuit 12 includes the photodiode 11 shown in FIG. 1. The received light amplification circuit 13 amplifies a received light signal and feeds the resultant signal to the MPU 4. A test LED 27 is also included for testing.

In response to a data sampling command sent from the disaster-prevention panel receiver 1, the MPU 4 turns on the switch 15 when a wait time Tw inherent to each analog fire detector and dependent on a terminal address has elapsed. The MPU 4 thus brings the received light amplification circuit 13 into action. In this state, the infrared LED 9 is driven to glow. A smoke detection signal sent through the light reception circuit 12 and received light amplification circuit 13 is digitized through analog-to-digital conversion and stored in the memory 20. Smoke detection involving the infrared LED 9 and light reception circuit 12 is normally achieved using scattered light.

The smoke detection signal stored in the memory 20 of the MPU 4 is transmitted to the disaster-prevention panel receiver 1 in response to a polling command, which specifies an address, sent from the disaster-prevention panel receiver 1.

The MPU 4 compares a smoke detection signal, which is sampled in response to a sampling command sent from the disaster-prevention panel receiver 1, with a predetermined fire judgment level. If the MPU 4 judges from the results of comparison that a fire has broken out, the MPU 4 transmits an interrupt signal to the disaster-prevention panel receiver 1 immediately. The MPU 4 causes the disaster-prevention panel receiver 1 to locate an analog fire detector that has detected a fire. The analog fire detector judging that a fire has broken out is thus specified. Thus, when an analog fire detector judges that a fire has broken out, even if polling is not performed, the judgment is transmitted immediately from the fire detector to the disaster-prevention panel receiver 1.

A smoke detection signal sampled by the MPU 4 is fed to the reply signal output circuit 25. The replay signal output circuit 25 transmits a signal to the disaster-prevention panel receiver 1 in the form of a current. The MPU 4 and succeeding circuits are activated with application of a constant voltage by a constant voltage circuit 26. The sensor base 30*a* includes an alarm indicator circuit 21. The alarm indicator circuit 21 lights an alarm indicator exposed to outside in case of a fire.

Figure 5:
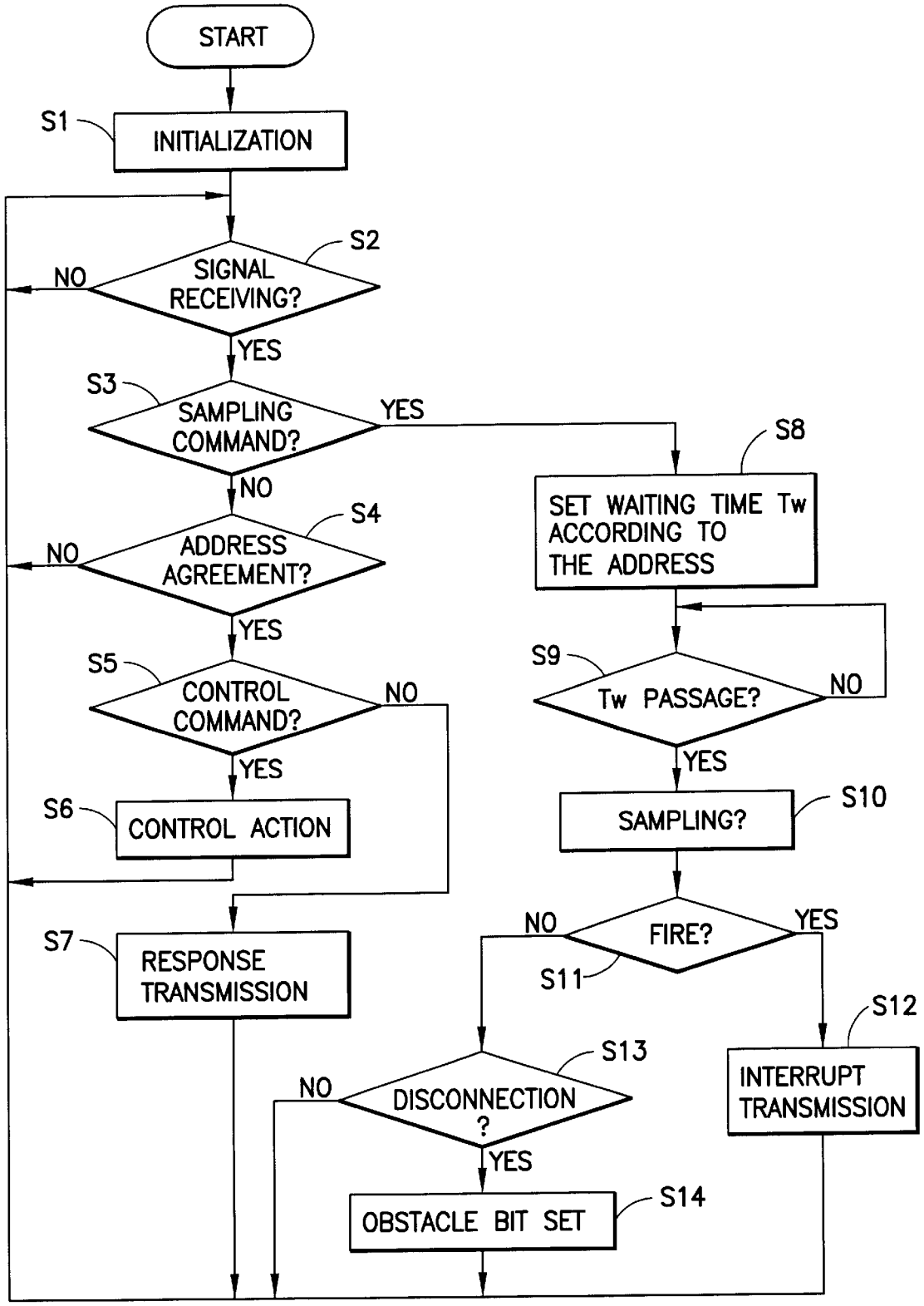
FIG. 5 is a flowchart describing processing to be performed by the analog fire detector shown in FIG. 4.

FIG. 5 is a flowchart describing processing to be performed by the analog fire detector shown in FIG. 4. First, the power supply is turned on. At step S1, predetermined initialization is performed. At step S2, it is checked if any signal has been received from the disaster-prevention panel receiver 1. If a signal has been received from the disaster-prevention panel receiver 1, control is passed to step S3. The received signal is checked to see if it is a sampling command.

If the received signal is not a sampling command, control is passed to step S4. It is checked if a calling address specified in the command agrees with an own address of the sensor. If the address agrees with the own address, control is passed to step S5. It is then check if the received signal is a control command.

If the control command is a normal polling command, control is passed to step S7. The up-to-date smoke detection signal is read from the memory 20 and transmitted to the disaster-prevention panel receiver 1. Thus, a reply is transmitted to the disaster-prevention panel receiver 1.

If the control command is a command instructing testing of the sensor, control is passed to step S6. A designated testing of the sensor is then carried out.

In contrast, if it is found at step S3 that the received signal is a sampling command, control is passed to step S8. A wait time Tw dependent on an address assigned to the sensor is set. At step S9, the passage of the wait time Tw is awaited.

When the wait time Tw elapses at step S9, control is passed to step S10. Driving for glowing and sampling through analog-to-digital conversion are carried out. The processing of step S10 includes sampling of a smoke detection signal and a noise detection signal and de-influence of a noise, which are described in FIG. 3 and performed according to the present invention.

The wait time Tw dependent on an address is set at step S9. At this time, the wait time Tw is set to a value that is different among the analog fire detectors 3A. This is intended to prevent excessive power consumption by the disaster-prevention panel receiver 1. Specifically, when a plurality of analog fire detectors 3A is connected to the disaster-prevention panel receiver 1 shown in FIG. 1 over a transmission line, if all the sensors simultaneously drive their infrared LEDs in response to a sampling command, a too large current flows along the transmission line. This leads to an increase in the power consumption by the disaster-prevention panel receiver 1.

At step S10, sampling of a smoke detection signal accompanied by noise de-influence is performed in accordance with the present invention. Thereafter, at step S11, the smoke detection signal stored in the memory 20 is compared with the predetermined fire judgment level stored in the EEPROM 6 in order to judge whether a fire has broken out. If it is judged that a fire has broken out, control is passed to step S12. An interrupt is transmitted to the disaster-prevention panel receiver 1.

In response to the interrupt, the disaster-prevention panel receiver 1 locates a fire detector that has detected a fire, and thus specifies the fire detector that is the transmission source of the interrupt and has detected a fire. The disaster-prevention panel receiver 1 then performs fire interrupt processing instead of normal polling, that is, causes the fire detector, which has sent the interrupt because it has detected a fire, to immediately return the up-to-date smoke detection signal.

If it is found at step S11 that a fire has not broken out, control is passed to step S13. A smoke detection signal sampled at that time is checked to see if it falls within a predetermined short circuit judgment range of signal levels. Occurrence of a short circuit is thus judged. If a short circuit has occurred, control is passed to step S14. Failure data is acquired and returned as reply data to a polling command in the form of a bit included in a data stream.

Figure 6:
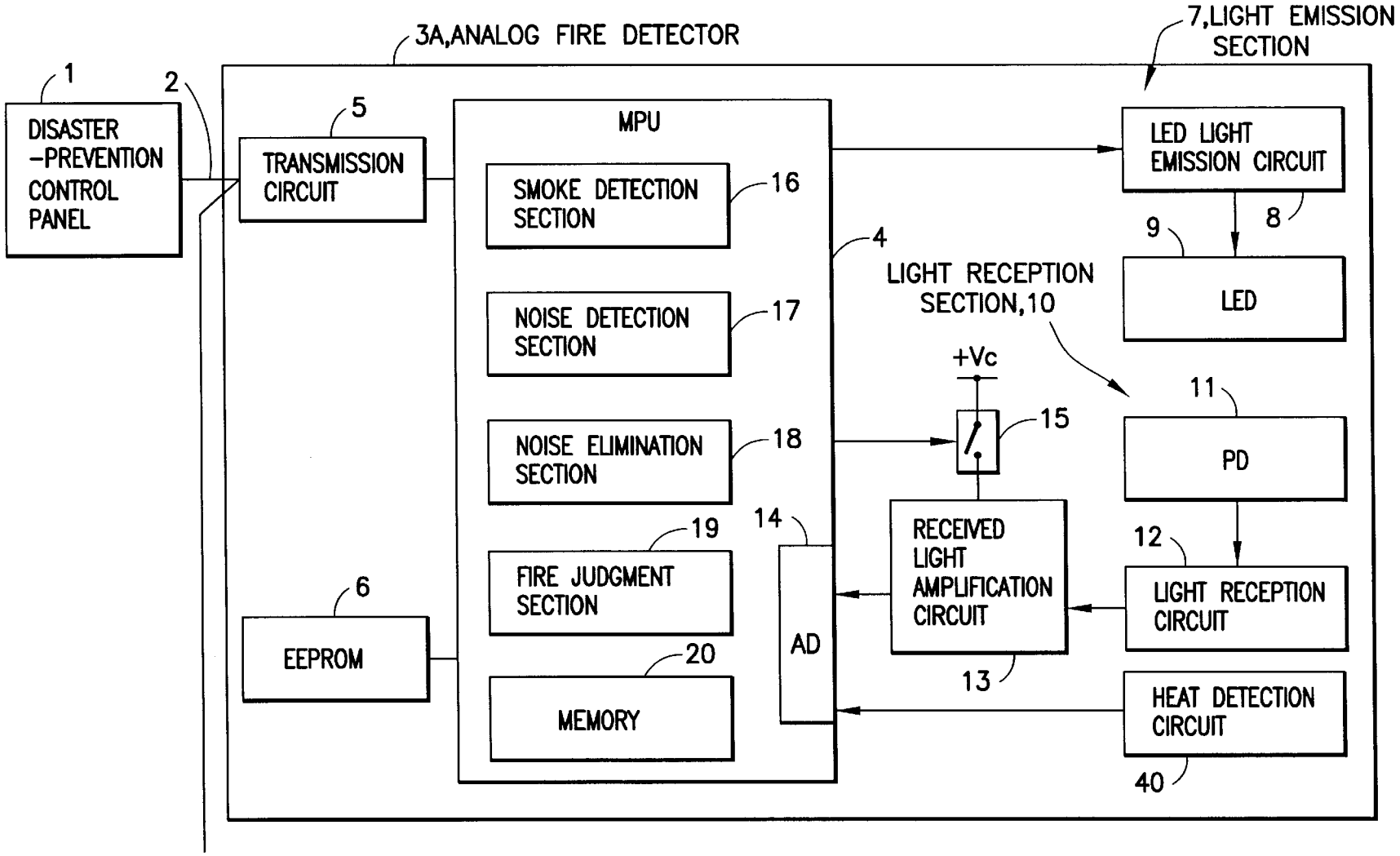
FIG. 6 is a block diagram showing another example of the analog fire detector in accordance with the present invention.

FIG. 6 shows another example of the analog fire detector with a noise de-influence facility in accordance with the present invention. In this example, when a detected temperature is equal to or larger than a predetermined value, noise de-influence is forcibly discontinued.

Referring to FIG. 6, the analog fire detector 3A connected to the disaster-prevention panel receiver 1 over the transmission line 2 is fundamentally identical to the one shown in FIG. 1. A difference lies in that a heat detection circuit 40 is included in the MPU 4.

The heat detection circuit 40 has a temperature detection element such as a thermistor installed outside the sensor body. Temperature affected by hot air stemming from a fire can be detected. The temperature detection element may be included in the sensor. Moreover, the temperature characteristic of diodes mounted□in the circuit may be utilized in order to detect the temperature in the sensor. A temperature detected by the heat detection circuit 40 is digitized by the A/D converter 14 and sampled duly. When the temperature detected by the heat detection circuit 40 is equal to or larger than a predetermined value, the noise de-influence unit 18 judges that there is a high possibility of a fire. In this case, noise de-influence is forcibly discontinued.

When an ambient temperature exceeds the predetermined value, even if a noise detection signal sampled by the noise detection section 17 exceeds the predetermined noise judgment level, the contents of the memory 20 are updated with an up-to-date smoke detection signal sampled by the smoke detection section 16. Consequently, the up-to-date smoke detection signal can be transmitted to the disaster-prevention panel receiver 1 without being interrupted by noise de-influence. Moreover, it can be judged from the up-to-date smoke detection signal whether a fire has broken out.

Figure 7:
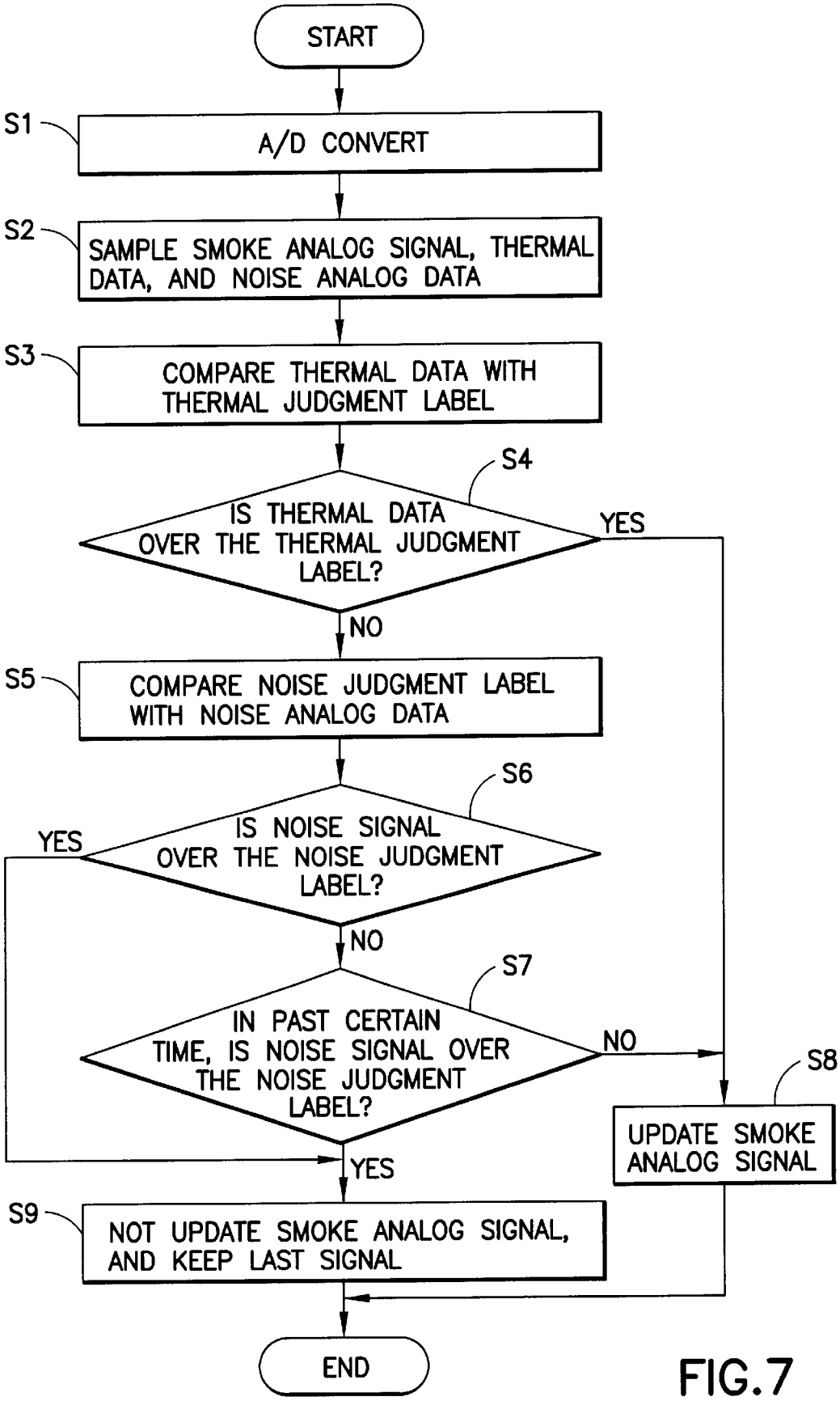
FIG. 7 is a flowchart describing smoke detection and noise de-influence to be performed by an MPU shown in FIG. 6.

FIG. 7 is a flowchart describing sampling of a smoke detection signal and de-influence of a noise to be performed in the analog fire detector shown in FIG. 6.

Referring to FIG. 7, at step S1 of analog-to-digital conversion, a smoke detection signal produced by the received light amplification circuit 13 included in the light reception section 10 when the infrared LED glows is digitized and thus sampled. A noise detection signal produced when the infrared LED does not glow is digitized and sampled. Moreover, temperature data provided by the heat detection circuit 40 is digitized and sampled.

At step S2, the smoke detection signal, noise detection signal, and temperature data are sampled. At step S3, the temperature data is compared with a value pre-set in the EEPROM 6. At step S4, if the temperature data exceeds the predetermined value, noise de-influence of steps S5, S6, and S7 is skipped and control is passed to step S8. A previous smoke detection signal is updated with the up-to-date smoke detection signal.

If it is found at step S4 that the temperature data does not exceed the predetermined value, the noise detection signal is compared with the noise judgment level at step S5. If it is found at step S6 that the noise detection signal exceeds the noise judgment level, the previous smoke detection signal is not updated and held intact at step S9.

If the noise detection signal does not exceed the noise judgment level, control is passed to step S7. If the noise detection signal has not exceeded the noise judgment level for the past certain time, the previous smoke detection signal is updated with the up-to-date smoke detection signal. If the noise detection signal has exceeded the noise judgment level for the past certain time, the previous smoke detection signal is not updated but held intact in order to de-influence a noise at step S9.

In the fire detector, when a temperature newly detected by the heat detection circuit 40 is equal to or larger than the predetermined value, if the temperature is higher than the previously detected temperature, a certain value is added to the previous temperature and the resultant value is stored as a newly detected temperature. This will prove effective in preventing a malfunction of the heat detection circuit 40 caused by a noise.

The heat detection circuit 40 may be affected by a noise and a detected temperature provided thereby may exhibit an abrupt rise. In this case, noise de-influence performed by the fire detector may be discontinued incorrectly. In general, it is rare that a detected temperature exhibits an abrupt rise relative to the previously detected temperature. It is prevented that the heat detection circuit 40 produces an incorrect signal while being affected by a noise.

Figure 8:
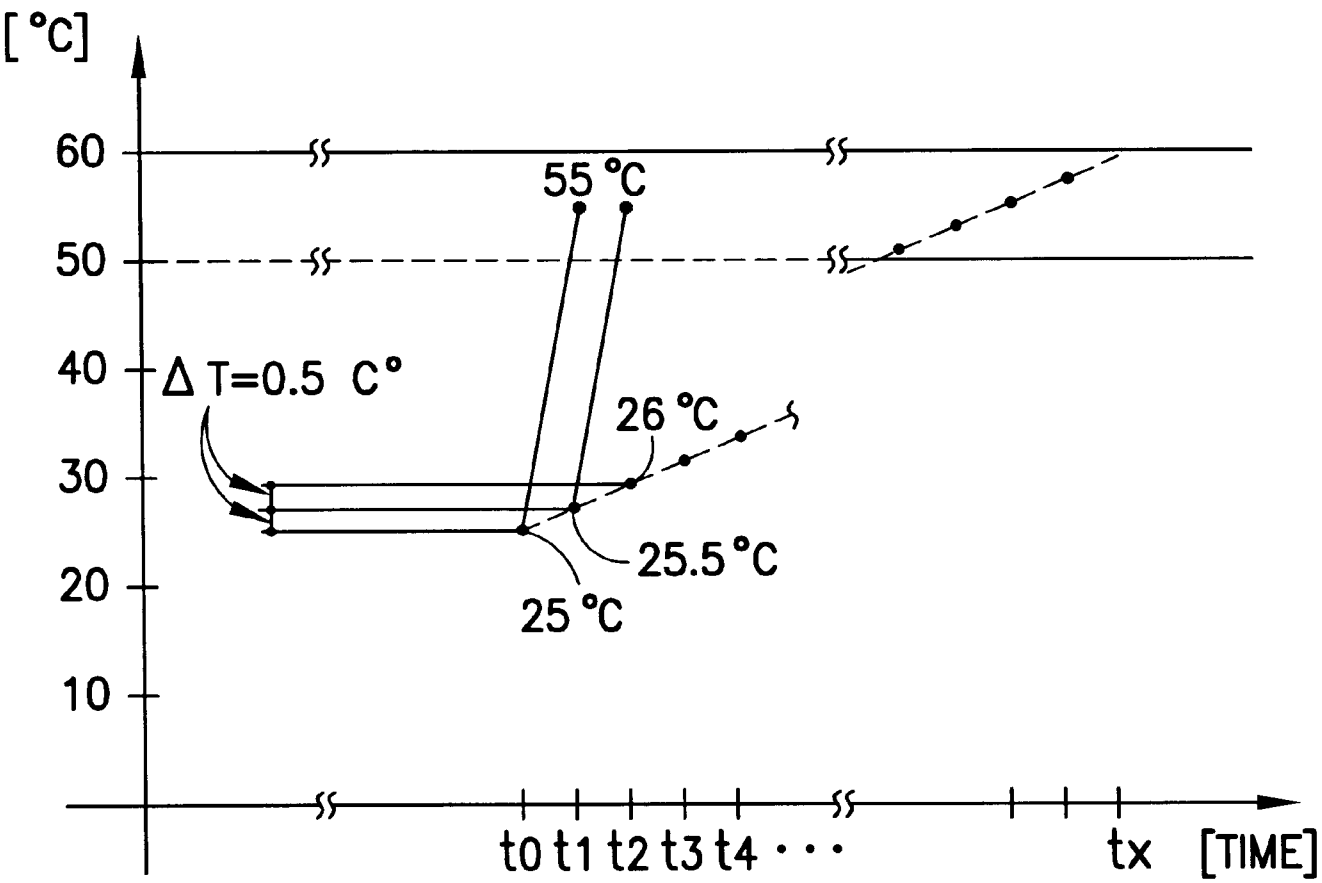
FIG. 8 is a graph for explaining de-influence of the adverse effect of a noise from a detected temperature provided by the analog fire detector shown in FIG. 6.

In the fire detector of this example, as shown in FIG. 8, in addition to the predetermined value (for example, 60° C.) relative to which a detected temperature is compared in order to judge whether noise de-influence should be discontinued, another predetermined value (for example, 50° C.) may be determined. When a detected temperature exhibits an abrupt rise because of a noise occurring in the temperature detection circuit, a certain value ΔT (for example, ΔT=0.5° C.) is added to the previously detected temperature. The resultant value is stored as a newly detected temperature but noise de-influence performed by the fire detector is not discontinued immediately.

As shown in FIG. 8, assume that the heat detection circuit 40 has detected ambient temperature as 25° C. by time instant t0, and that 55° C. is detected at time instant t1. In this case, 25.5° C. calculated by solving the addition of 25° C.+0.5° C. is output as a newly-detected temperature instead of 55° C. Thus, noise de-influence performed during smoke detection in the fire detector will not be discontinued immediately.

If the temperature rise is derived from a noise, the next detected temperature will assume a normal value lower than the predetermined value because it is detected without being affected by a noise.

If the detected temperature is a real temperature detected while being unaffected by a noise, temperatures detected at time instants t2, t3, etc. will exhibit a continuous rise. The detected temperatures will exceed the predetermined level. The certain value of 0.5° C. is continuously added to a previously detected temperature. The temperature detected at time instant tx will exceed the predetermined value of 60° C. at which noise de-influence is discontinued. The fire detector discontinues noise de-influence performed during smoke detection, and goes into its normal action.

Figure 9:
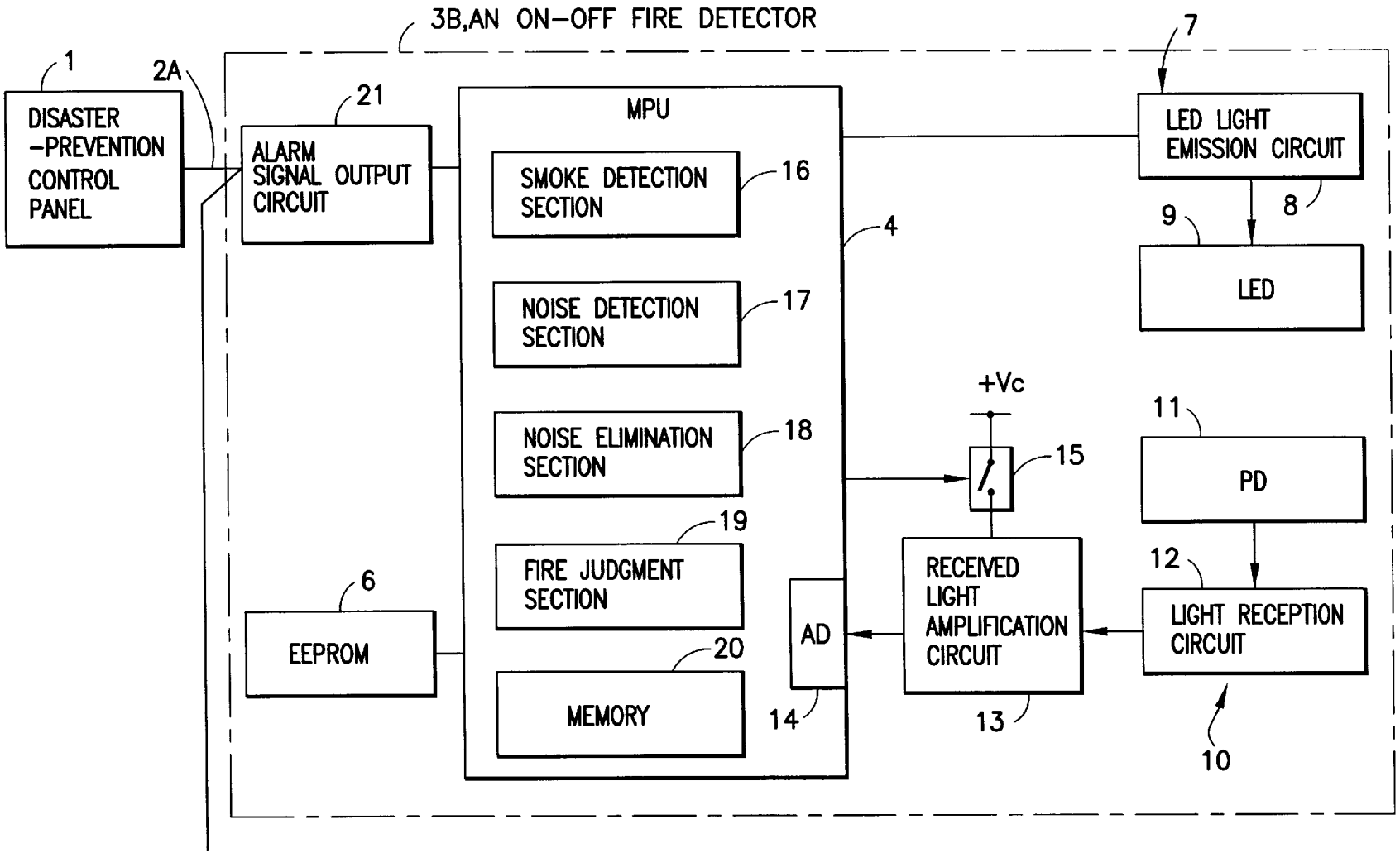
FIG. 9 is a block diagram showing an on-off fire detector with a noise de-influence facility in accordance with the present invention.

FIG. 9 is a block diagram showing an on-off fire detector with a noise de-influence facility in accordance with the present invention.

Referring to FIG. 9, an on-off fire detector 3B is connected to a disaster-prevention panel receiver 1 over a signal line 2A. The on-off fire detector 3B has a fire signal transmission circuit 21 substituted for the transmission circuit 5 included in the analog fire detector 3A shown in FIG. 1. When a fire judgment section 19 of an MPU 4 judges that a fire has broken out, the fire signal transmission circuit 21 transmits a fire signal to the disaster-prevention panel receiver 1.

The fire signal transmission circuit 21 in the on-off fire detector 3B is succeeded by an MPU 4, an EEPROM 6 that is a nonvolatile memory, a light emission section 7, and a light reception section 10. The light emission section 7 consists of an LED light emission circuit 8 and an infrared LED 9. The light reception section 10 consists of a photodiode (PD) 11 that is a light-receiving element, a light reception circuit 12, a received light amplification circuit 13, and a switch 15.

The MPU 4 has a smoke detection section 16, a noise detection section 17, a noise de-influence unit 18, a fire judgment section 19, and an A/D converter 14. The components of the fire detector except the fire signal transmission circuit 21 are basically identical to those of the analog fire detector 3A shown in FIG. 1. A difference from the analog fire detector 3A lies in the control facilities of the MPU 4 included in the on-off fire detector 3B. Specifically, the light emission section 7 is driven to glow at intervals of, for example, 3 sec that is a sampling interval. A smoke detection signal produced by the light reception section 10 is sampled. The smoke detection signal is compared with a predetermined fire judgment level. The fire detector itself then judges whether a fire has broken out.

The actions of the noise detection section 17 and noise de-influence unit 18 are basically identical to those of the noise detection section and noise de-influence unit included in the analog fire detector 3A.

Even in the on-off fire detector 3B, during a sampling period during which the MPU 4 drives the light emission section 7 and thus causes it to glow, the received light amplification circuit 13 is activated as shown in FIG. 2. Moreover, the infrared LED 9 glows during the glowing period shown in FIG. 2, and the A/D converter 14 digitizes a signal for sampling as shown in FIG. 2. A smoke detection signal and a noise detection signal are sampled according to the flowchart of FIG. 3, and noise de-influence is performed based on the results of comparison of the noise detection signal with a noise judgment level.

Figure 10:
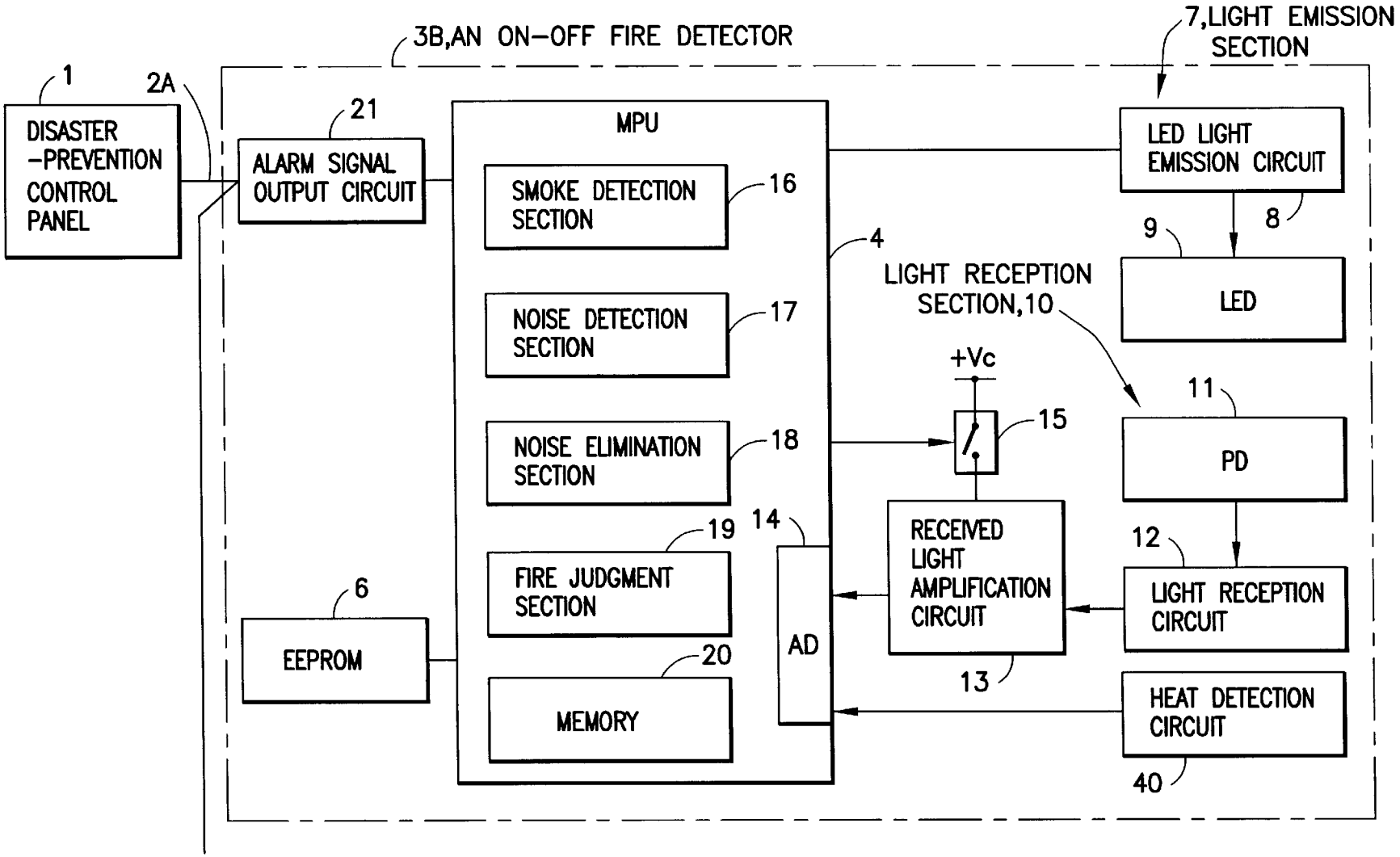
FIG. 10 is a block diagram showing another example of the on-off fire detector in accordance with the present invention.
Figure 11:
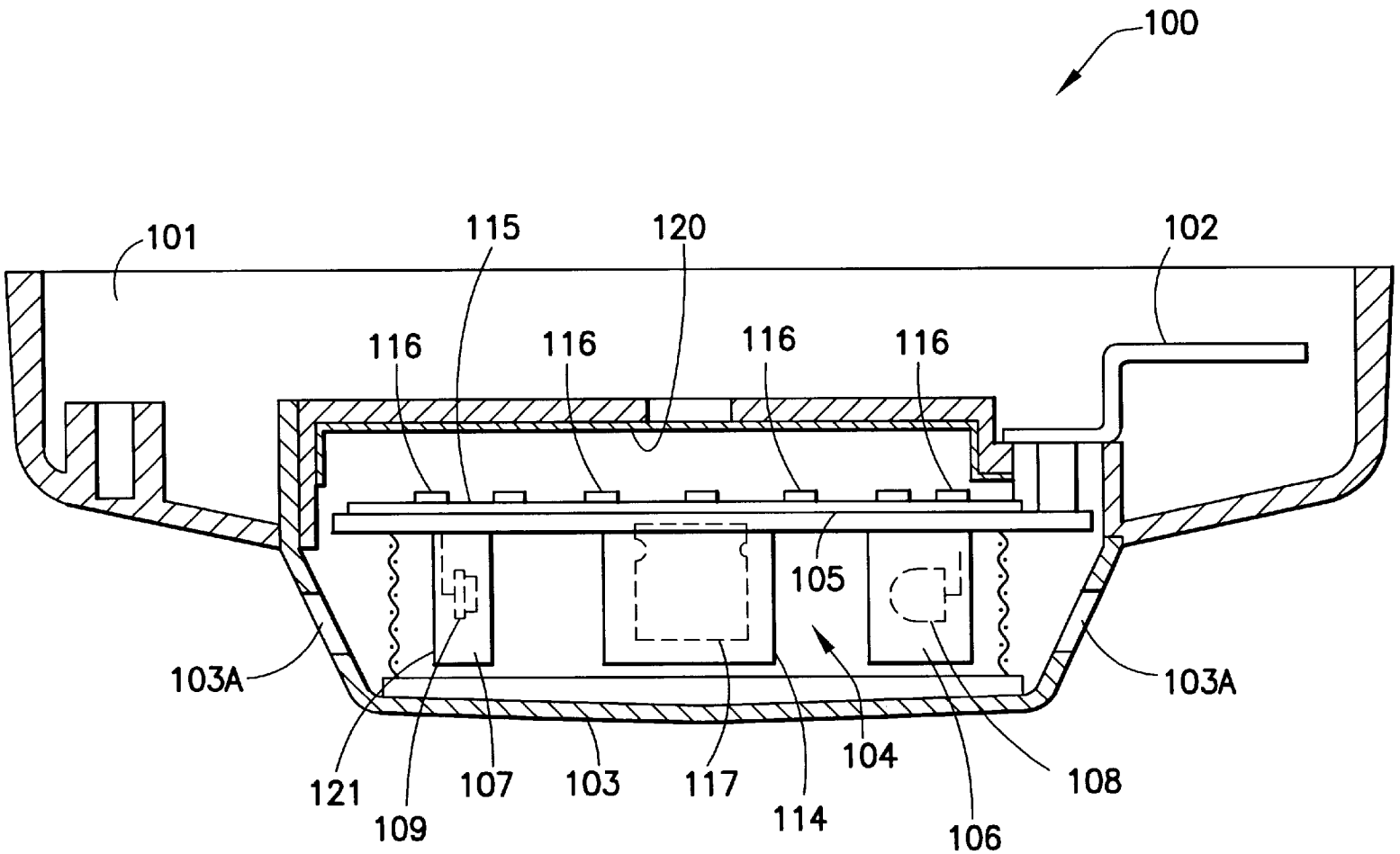
FIG. 11 is a cross-sectional view of a conventional fire detector showing an adopted countermeasure against noises.

FIG. 10 shows another example of the on-off fire detector with a noise de-influence facility in accordance with the present invention. In this example, when a detected temperature is equal to or larger than a predetermined value, noise de-influence is forcibly discontinued.

The MPU 4 included in the on-off fire detector 3B is, as shown in FIG. 10, provided with a heat detection circuit 40. The heat detection circuit 40 detects ambient temperature in the presence of hot air stemming from a fire, and the A/D converter 14 digitizes a detected temperature for sampling. When the detected temperature exceeds the predetermined value, the noise de-influence unit 18 of the MPU 4 forcibly discontinues noise de-influence. Even if a noise detection signal exceeds a noise judgment level, noise de-influence is not carried out. Instead, the up-to-date smoke detection signal is compared with a fire judgment level. Thus, the sensor judges by itself whether a fire has broken out.

Smoke detection and noise de-influence to be performed by the on-off fire detector shown in FIG. 10 are basically identical to those described in the flowchart of FIG. 7 describing smoke detection and noise de-influence to be performed by the analog fire detector.

In this example, when the noise detection signal exceeds the predetermined noise judgment level, updating with a new smoke detection signal is disabled so that the previous smoke detection signal will be held intact. The gist of the present invention is such that when the noise detection signal exceeds the predetermined noise judgment level, a noise is de-influenced for fear it may be judged from a smoke detection signal, which may contain a noise, that a fire has broken out.

For example, when the noise detection signal exceeds the predetermined noise judgment level, the fire judgment section may be disabled from performing fire judgment or from providing an output.

In the aforesaid examples, the light emission sections 7 and light reception sections 10 included in the analog fire detector 3A and on-off fire detector 3B photoelectrically detects smoke. Specifically, the light reception section is located off the optical axis of the light emission section, and receives light that has emitted from the light emission section and scattered because of smoke. Other photoelectric smoke detection methods include an attenuated light method and a reflected light method. According to the attenuated light method, light having emitted from the light emission section and attenuated because of smoke is detected. According to the reflected light method, light emitted from the light emission section is irradiated to a reflector located beyond a smoke inflow space, and reflected light is received by the light reception section in order to detect smoke.

In the aforesaid examples of the analog fire detector 3A, the sensor performs noise de-influence. Alternatively, the disaster-prevention panel receiver 1 may perform noise de-influence. In this case, at least a noise detection signal is transmitted to the disaster-prevention panel receiver.

In the aforesaid examples, the analog fire detectors or on-off fire detectors are connected to the disaster-prevention panel receiver 1. Alternatively, a plurality of repeaters may be connected to the disaster-prevention panel receiver serving as a centralized monitoring system. The plurality of analog fire detectors or on-off fire detectors may then be connected to the repeaters over transmission lines led out from the repeaters.

As described so far, according to the present invention, not only a smoke detection signal but also a noise is detected. When the noise has a large level, the smoke detection signal sampled at that time is unused. The previous smoke detection signal containing no noise is used. Even when a noise persisting for a long time occurs instead of an instantaneous noise, an incorrect judgment on a fire can be prevented reliably.

Even when smoke detection is intermittently affected by a noise, unless the absence of a noise persists for a certain time, noise de-influence is continued. Even an intermittent noise is de-influenced reliably, and an incorrect judgment on a fire can be prevented reliably.

According to the present invention, noise de-influence is performed by software installed in the MPU. High-cost circuit elements including noise absorption elements need not be included. A minimum number of currently available noise absorption elements should merely be used to cope with noises.

In the past, noises have been coped with through cutting for patterning and trial. According to the present invention, noise de-influence is performed by software. Noises can be de-influenced to some extent. If a malfunction actually occurs because of a noise, measures can be taken immediately.

Furthermore, when a detected ambient temperature is equal to or larger than a predetermined value, noise de-influence can be discontinued forcibly. Higher priority can be given to detection of an actual fire than that given to noise de-influence. It can be prevented that detection of an actual fire is retarded because of noise de-influence.

What is claimed is:

1. A fire detector having a light emission section to be driven to glow at regular intervals, a light reception section for receiving light emitted from said light emission section and varied depending on smoke, and a smoke detection section for sampling as a smoke detection signal a signal output from said light reception section when said light emission section glows, and updating a previous smoke detection signal, said fire detector comprising:

a noise detection section for sampling as a noise detection signal a signal output from said light reception section when said light emission section does not glow; and a noise de-influence unit for when said noise detection signal exceeds a predetermined noise judgment level, processing to de-influence a noise.

2. A fire detector according to claim 1, wherein when said noise detection signal exceeds the predetermined noise judgment level, said noise de-influence unit disables updating of the previous smoke detection signal with a smoke detection signal sampled by said smoke detection section thereby processing to de-influence a noise.

3. A fire detector according to claim 1 or claim 2, wherein said light reception section includes a received light amplification circuit that acts for a certain period starting before and ending after a glowing period of said light emission section during which said light emission section glows, and said noise detection section samples said noise detection signal at a time instant within the action period of said received light amplification circuit, during which said received light amplification circuit is in action, except the glowing period of said light emission section.

4. A fire detector according to claim 3, wherein said noise detection section samples a noise signal when a sufficiently long time during which the noise signal is, unaffected by said light emission section has elapsed after the end of the glowing period of said light emission section.

5. A fire detector according to claim 4, further comprising a temperature detection section for detecting ambient temperature, wherein when a temperature detected by said temperature detection section is equal to or larger than a predetermined value, said noise de-influence unit forcibly discontinues noise de-influence.

6. A fire detector according to claim 4, further comprising a transmission section for transmitting a smoke detection signal sampled by said smoke detection section in response to a command sent from an upper-level device.

7. A fire detector according to claim 4, further comprising a fire signal transmission section for when a smoke detection signal sampled by said smoke detection section exceeds a predetermined fire judgment level, transmitting a fire detection signal to an upper-level device.

8. A fire detector according to claim 3, further comprising a temperature detection section for detecting ambient temperature, wherein when a temperature detected by said temperature detection section is equal to or larger than a predetermined value, said noise de-influence unit forcibly discontinues noise de-influence.

9. A fire detector according to claim 3, further comprising a transmission section for transmitting a smoke detection signal sampled by said smoke detection section in response to a command sent from an upper-level device such as a receiver or repeater.

10. A fire detector according to claim 3, further comprising a fire signal transmission section for when a smoke detection signal sampled by said smoke detection section exceeds a predetermined fire judgment level, transmitting a fire detection signal to an upper-level device.

11. A fire detector according to claim 2, wherein even when the noise detection signal does not exceed a predetermined noise judgment level, if the noise detection signal has exceeded the predetermined noise judgment level for a past certain time, said noise de-influence unit disables updating with a smoke detection signal sampled by said smoke detection section.

12. A fire detector according to claim 11, further comprising a temperature detection section for detecting ambient temperature, wherein when a temperature detected by said temperature detection section is equal to or larger than a predetermined value, said noise de-influence unit forcibly discontinues noise de-influence.

13. A fire detector according to claim 11, further comprising a transmission section for transmitting a smoke detection signal sampled by said smoke detection section in response to a command sent from an upper-level device.

14. A fire detector according to claim 11, further comprising a fire signal transmission section for when a smoke detection signal sampled by said smoke detection section exceeds a predetermined fire judgment level, transmitting a fire detection signal to an upper-level device.

15. A fire detector according to claim 2, further comprising a temperature detection section for detecting ambient temperature, wherein when a temperature detected by said temperature detection section is equal to or larger than a predetermined value, said noise de-influence unit forcibly discontinues noise de-influence.

16. A fire detector according to claim 15, wherein when a temperature newly detected by said temperature detection section becomes equal to or larger than the predetermined value, if the detected temperature is higher than the previously detected temperature, a certain value is added to the previously detected temperature and the resultant value is output as a newly detected temperature.

17. A fire detector according to claim 16, further comprising a transmission section for transmitting a smoke detection signal sampled by said smoke detection section in response to a command sent from an upper-level device.

18. A fire detector according to claim 16, further comprising a fire signal transmission section for when a smoke detection signal sampled by said smoke detection section exceeds a predetermined fire judgment level, transmitting a fire detection signal to an upper-level device such as a receiver or repeater.

19. A fire detector according to claim 6, further comprising a transmission section for transmitting a smoke detection signal sampled by said smoke detection section in response to a command sent from an upper-level device.

20. A fire detector according to claim 15, further comprising a fire signal transmission section for when a smoke detection signal sampled by said smoke detection section exceeds a predetermined fire judgment level, transmitting a fire detection signal to an upper-level device.

21. A fire detector according to claim 2, further comprising a transmission section for transmitting a smoke detection signal sampled by said smoke detection section in response to a command sent from an upper-level device.

22. A fire detector according to claim 2, further comprising a fire signal transmission section for when a smoke detection signal sampled by said smoke detection section exceeds a predetermined fire judgment level, transmitting a fire detection signal to an upper-level device such as a receiver or repeater.

23. A fire detector according to claim 1, further comprising a transmission section for transmitting a smoke detection signal sampled by said smoke detection section in response to a command sent from an upper-level device.

24. A fire detector according to claim 1, further comprising a fire signal transmission section for when a smoke detection signal sampled by said smoke detection section exceeds a predetermined fire judgment level, transmitting a fire detection signal to an upper-level device.

25. A fire detector having a light emission section for glowing at regular intervals, a light reception section for receiving light emitted from said light emission section and varied depending on smoke, a smoke detection section for sampling as a smoke detection signal a signal output from said light reception section when said light emission section glows, and a fire judgment section for when the smoke detection signal sampled by said smoke detection section exceeds a fire judgment level, judging that a fire has broken out, said fire detector comprising:

a noise detection section for sampling as a noise detection signal a signal output from said light reception section when said light emission section does not glow, wherein when the noise detection signal sampled by said noise detection section exceeds a predetermined noise judgment level, said fire judgement section is disabled from performing fire judgment or providing a fire output.

26. A noise de-influence method characterized in that:

a signal output from a light reception section for receiving light that is emitted from a light emission section and that is varied depending on smoke stemming from a fire is sampled as a detection signal;

a signal output from said light reception section when said light emission section does not glow is sampled as a noise detection signal;

when the noise detection signal exceeds a predetermined noise judgment level, a noise is de-influenced.

27. A noise de-influence method characterized in that;

a signal output from a light reception section for receiving light that is emitted from a light emission section and that is varied depending on smoke stemming from a fire is sampled as a smoke detection signal, and used to update a previous smoke detection signal;

a signal output from said light reception section when said light emission section does not glow is sampled as a noise detection signal; and when the noise detection signal exceeds a predetermined noise judgment level, updating the previous smoke detection signal with the newly sampled smoke detection signal is disabled in order to process to de-influence a noise.

* * * * *